US007793370B2

(12) United States Patent
Hampton

(10) Patent No.: US 7,793,370 B2
(45) Date of Patent: Sep. 14, 2010

(54) BED SKIRT ACCESSORY DEVICE

(76) Inventor: Sheralyn Hampton, 17587 Winding Creek Rd., Corral De Tierra, CA (US) 93908

( * ) Notice: Subject to any disclaimer, the term of this patent is extended or adjusted under 35 U.S.C. 154(b) by 0 days.

(21) Appl. No.: 12/258,461

(22) Filed: Oct. 27, 2008

(65) Prior Publication Data

US 2009/0089929 A1 Apr. 9, 2009

Related U.S. Application Data

(63) Continuation-in-part of application No. 11/473,399, filed on Jun. 23, 2006, now abandoned.

(51) Int. Cl.
*A47C 21/00* (2006.01)

(52) U.S. Cl. ..... 5/493; 5/658

(58) Field of Classification Search ..... 5/493, 5/482, 658, 659

See application file for complete search history.

(56) References Cited

U.S. PATENT DOCUMENTS 3,370,306 A * 2/1968 Lovette ..... 5/659
4,860,398 A 8/1989 Karpinski
4,897,891 A * 2/1990 Kallman et al. ..... 5/493
5,205,003 A 4/1993 Green
D540,604 S * 4/2007 Hart ..... D6/596

* cited by examiner

*Primary Examiner*—Fredrick Conley
(74) *Attorney, Agent, or Firm*—Mai Pare, Esq.

(57) ABSTRACT

A bed skirt enhancing apparatus for placement adjacent and beneath a bed skirt. In one embodiment, the bed skirt enhancing apparatus comprises multiple layers of rigid material gathered and joined together forming a ruffled, multi-layered sheath. The sheath spans a distance sufficient to surround a perimeter of a box spring of a mattress. A band or planar piece of fabric may be used for securing the sheath to the box spring. In an alternative embodiment of the invention, a ruffle insert for placement beneath a bed skirt comprises a planar panel, and a suspended ruffle skirt; whereby said suspended ruffle skirt comprises multiple layers of material; and whereby said multiple layers of material are held together by at least one monofilament latitudinal band.

3 Claims, 7 Drawing Sheets

BED SKIRT ACCESSORY DEVICE

This application claims priority from provisional application 60/692,984 filed Jun. 23, 2005 and is a continuation-in-part of application Ser. No. 11/473,399.

FIELD OF INVENTION

The present invention relates to the bedding field, which includes items such as fitted and flat sheets, comforters, duvet covers, shams, and bed skirts. A bed skirt refers to a decorative bedding accessory used to cover a box spring. Bed skirts typically extend from the upper most edge of a box spring, down to the floor or surface on which a box spring is placed. The bed skirt will also generally cover any gaps or space existing between a bed frame holding a box spring and the ground or surface. The present invention is intended as a accessory device to be used with a conventional bed skirt to increase the fullness and volume of a conventional bed skirt.

SUMMARY OF INVENTION

The present invention comprises of multiple embodiments of a bed skirt enhancing device intended to increase the fullness and volume of conventional bed skirts known in the art. Multiple layers of rigid material are superimposed upon each other and constructed in a manner so that the multiple layers assume a full and ruffled appearance. There are two embodiments of the invention. The first embodiment comprises a single unit wherein a multi-layered sheath surrounds an entire box spring. The second embodiment is a ruffle insert which may include a planar panel and suspended ruffle skirt. Multiple ruffle inserts may be used to surround the perimeter of the box spring depending upon the preferences of the user.

DETAILED DESCRIPTION OF A PREFERRED EMBODIMENT OF THE INVENTION

The present invention is intended for use with a bed skirt. Bed skirts are accessory pieces that are placed above a box spring to cover the box spring and any area between a box spring and a surface on which a box spring is placed. Box springs are generally comprised of loud and unattractive floral fabrics. Often box springs are placed on metal bed frames that raise the box spring above the floor or surface on which it is resting.

Users often wish to obscure box springs and bed frames through the use of bed skirts and the use of bed skirts are mainstream and commonplace. The present invention enhances the appearance of a bed skirt and enables a bed skirt to have a fuller, more attractive appearance.

Figure 1:
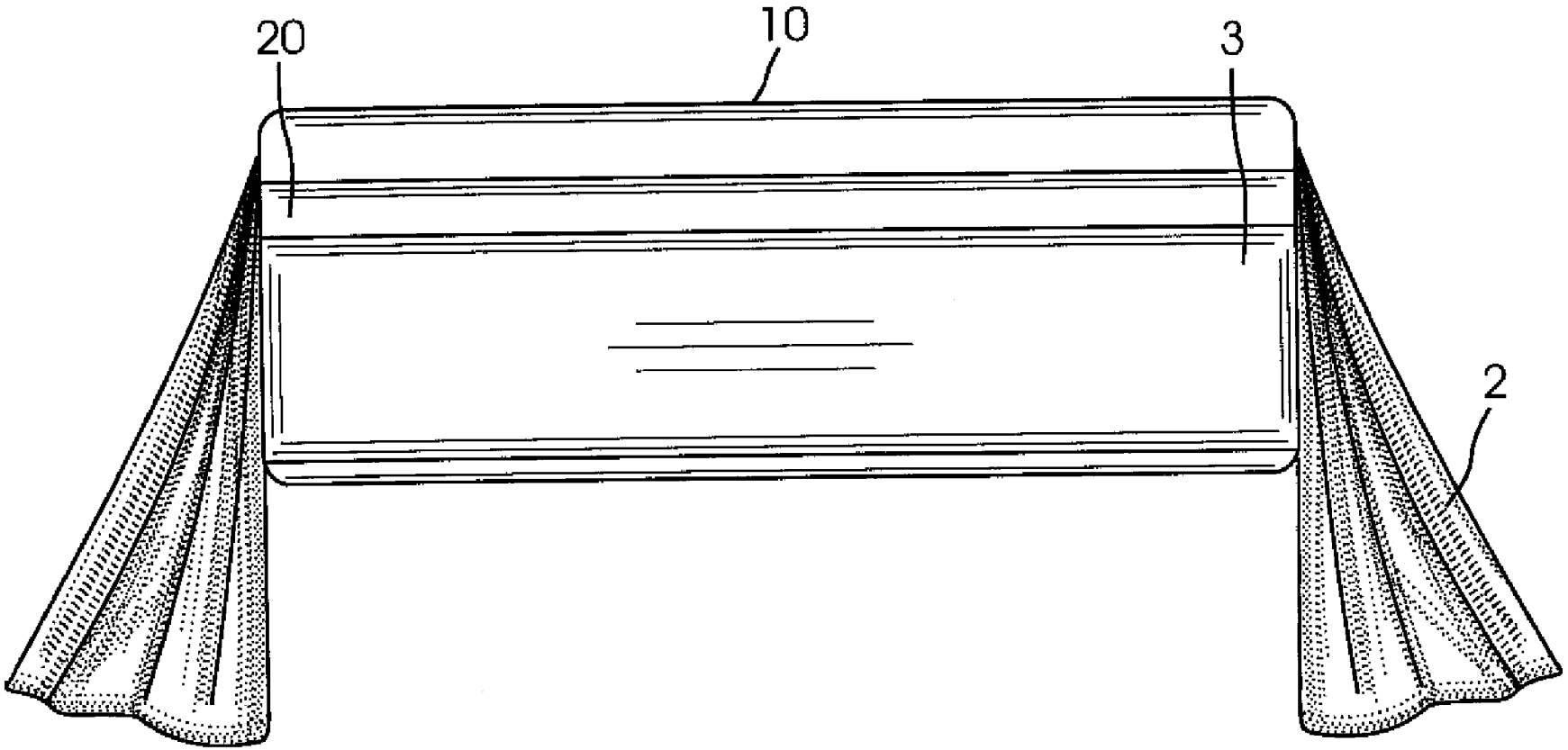
FIG. 1 shows a planar view of the present invention assembled on a box spring from the head position of a box spring.

FIG. 1 shows the present invention in use with a bed skirt 2 and box spring 3. In the preferred embodiment, the device is placed underneath a bed skirt and is not visible to a casual observer. The effects of the device however are apparent, and distinctly provide a fuller, more voluminous appearance to a bed skirt. As shown in FIG. 1, the present invention causes a bed skirt to prominently flair outwards.

The present invention may cover only the sides of the box spring that are visible to the observer. Generally the device will not cover the head portion 10 of the box spring, as shown in FIG. 1, because this portion is usually placed against a wall or headboard, and therefore, is not visible to the observer. Because the device is intended to increase the volume of a bed-skirt and improve the appearance of the bed skirt, it has no purpose on an unexposed side of a box spring. Furthermore, users will typically prefer to place the head of a box spring flush against a wall so voluminous material is undesirable in the head area of a box spring.

Figure 2:
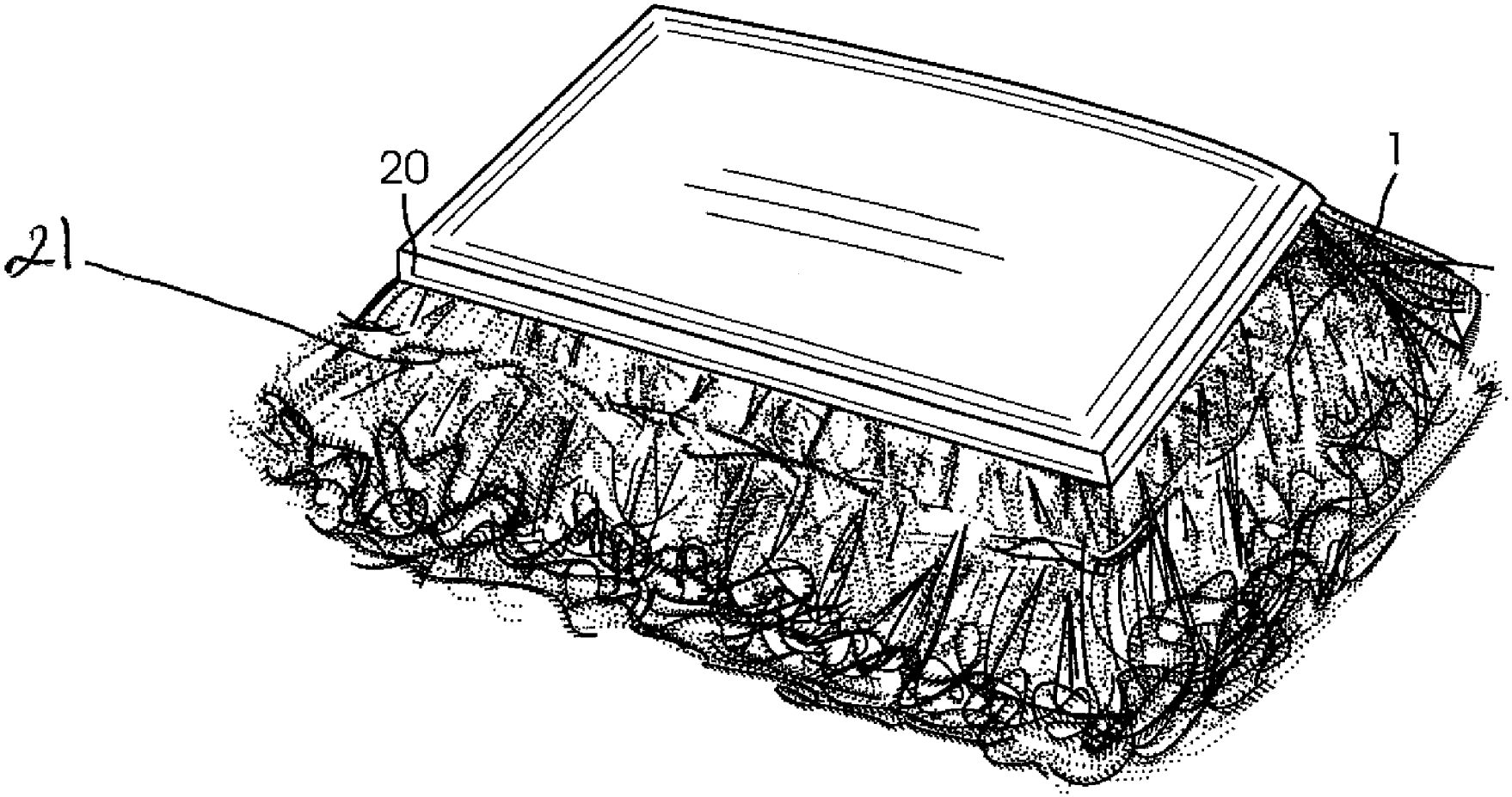
FIG. 2 shows a perspective view of a first embodiment of the present invention placed on a box spring without a bed skirt.

FIG. 2 shows the present invention placed over a box spring without a bed skirt. The device is comprised of multiple layers of material that are gathered and stitched to form a ruffled appearance. Multiple layers of material joined together through stitching to form a multi-layered ruffled sheath 1. Also joining the multiple layers of material together is a monofilament that is integrated within the multiple layers and forming monofilament latitudinal bands 21. The monofilament latitudinal bands hold the multiple layers together in a gathered configuration. Through the use of the monofilament latitudinal bands, the multi-layered ruffled sheath tapers inwards in the region where the monofilament latitudinal bands are located, and tiers outwards, where the monofilament latitudinal bands are not located.

In a preferred embodiment of the present invention, the device is attached to a box spring through an elasticized band 20 that is attached to the ruffled sheath. FIG. 1 shows the location where opposite ends of the band are joined in order to secure the ruffled sheath to a box spring. The band may be joined at opposite ends through attachment means such as snaps, buttons, hooks, fabric hook and loop fasteners, or by simply tying the two ends.

Figure 3:
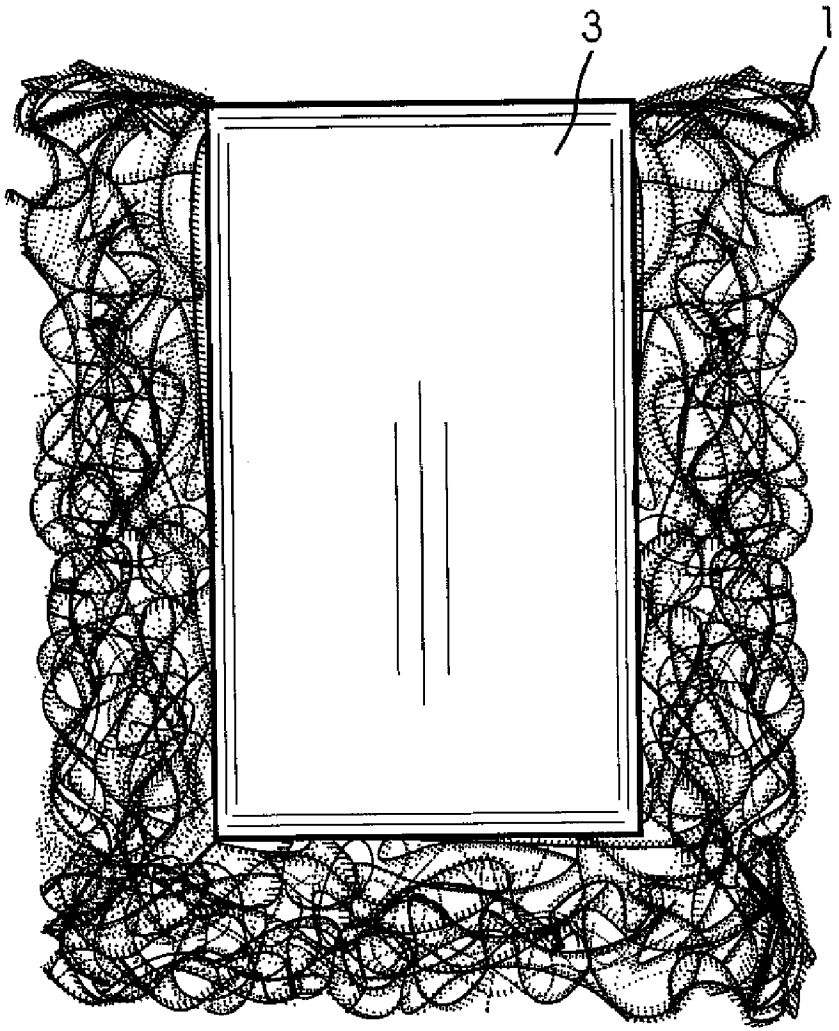
FIG. 3 shows a planar view of the present invention from underneath a box spring.

FIG. 3 shows the present invention when viewed from underneath the box spring. The layers of material are configured so that bulk is created from the layers of material. The multi-layered sheath maintains its volume notwithstanding the placement of a bed skirt above it.

Figure 4:
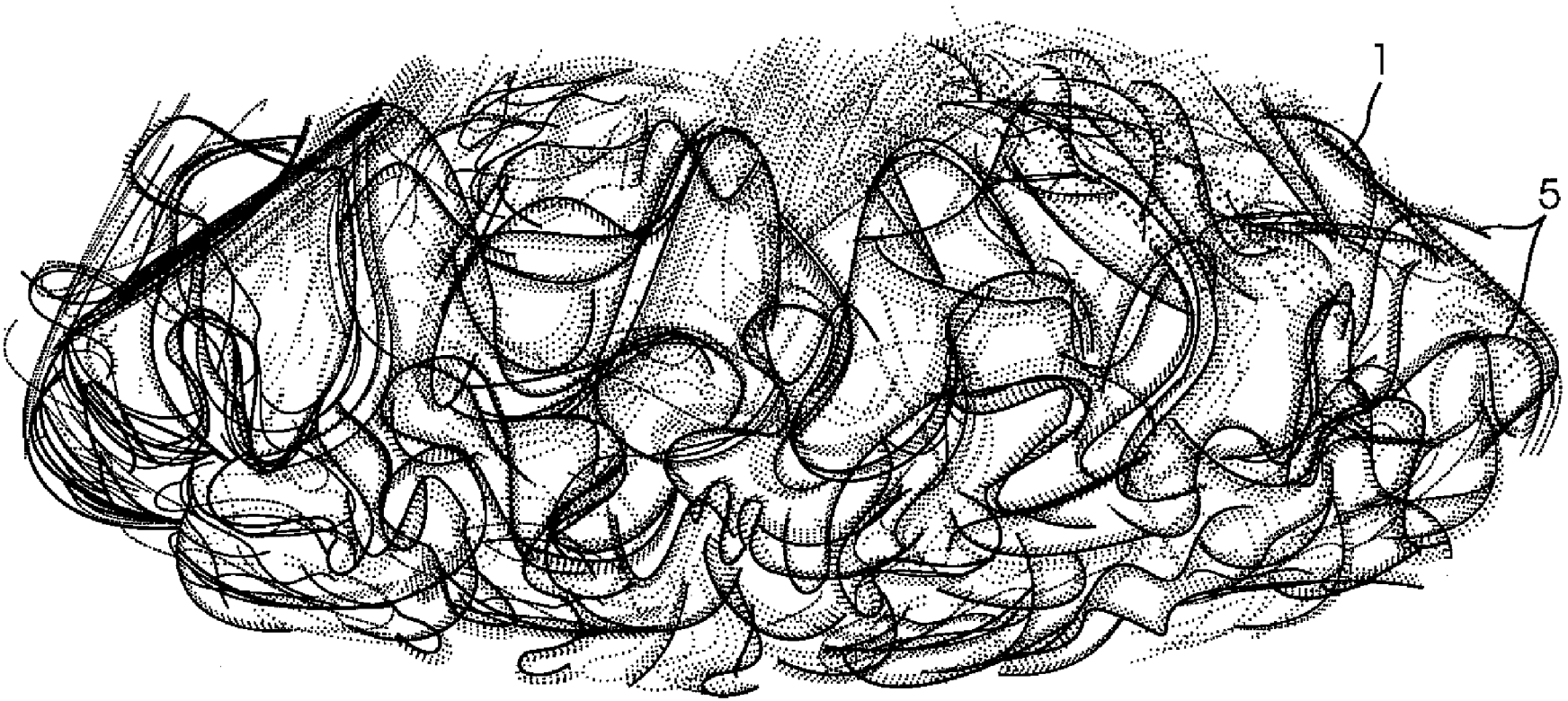
FIG. 4 shows a close up sectional view of the present invention.

FIG. 4 is a close up section of the ruffled sheath. The sheath may be constructed from a variety of rigid materials. Ideal materials allow for the sheath to maintain its shape even when compressed. Suitable materials include tulle, netting, floral material, crinoline, organza, and/or taffeta. Wire or piping 5 may be incorporated in the lower most edge of the layers of material to provide additional rigidity within the sheath and lend a fuller appearance to a bed skirt. The material should allow for volume and fullness when gathered and held in a ruffled configuration. The material may be machine washable, to allow for convenient care and cleaning for a user.

Figure 5:
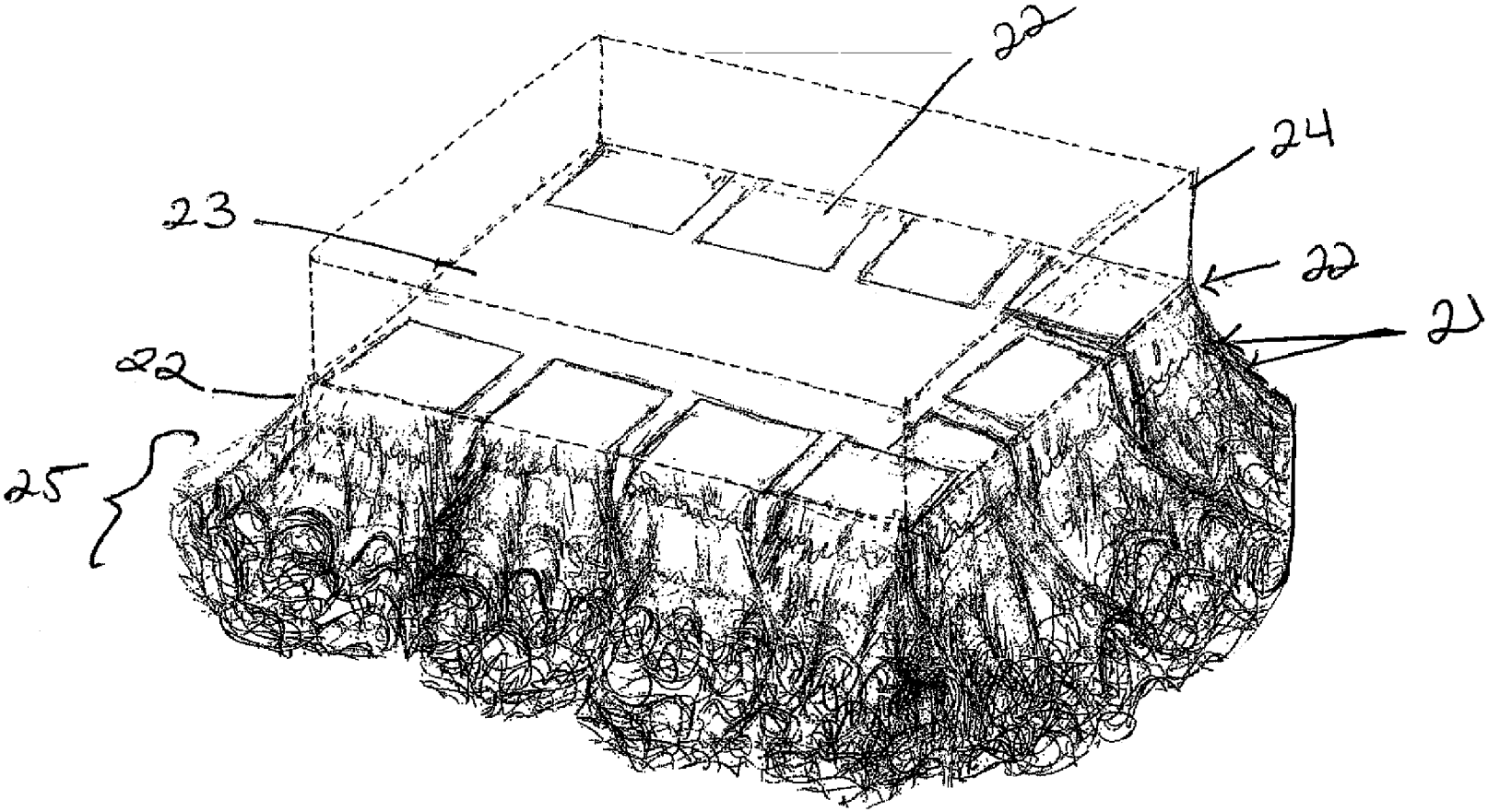
FIG. 5 shows multiple ruffle inserts installed between a mattress and a box spring assembly

An alternative embodiment of the present invention is shown in FIG. 5 whereby multiple ruffle inserts 22 are positioned between a box spring 23 and mattress 24 in accordance with the preferences of the user. In the preferred assembly employing the ruffle inserts, more than one ruffle insert is positioned between the mattress and box spring.

When installed in a mattress and box spring assembly, multiple ruffle inserts are employed so that the ruffle inserts completely surround the perimeter of the box spring. In FIG. 5, ten individual ruffle inserts are utilized in the box spring and mattress assembly.

To facilitate the understanding of how the ruffle inserts 22 are installed, the mattress in FIG. 5 is depicted as if the mattress 24 were transparent. The assembly in FIG. 5 comprises a box spring 23, a mattress 24, and ruffle inserts 22. The ruffle inserts are placed beneath the mattress and the weight of the mattress keeps the ruffle inserts held into position. The number of ruffle inserts that are used in a mattress/box spring assembly may vary, depending on the preferences of the user. More ruffle inserts may be used for king size beds and fewer ruffle inserts may be used for twin or single sized beds.

As illustrated in FIG. 5, the ruffle inserts have a voluminous, tiered appearance, with the lowermost portion 25 of the apparatus swinging outwards.

Figure 6:
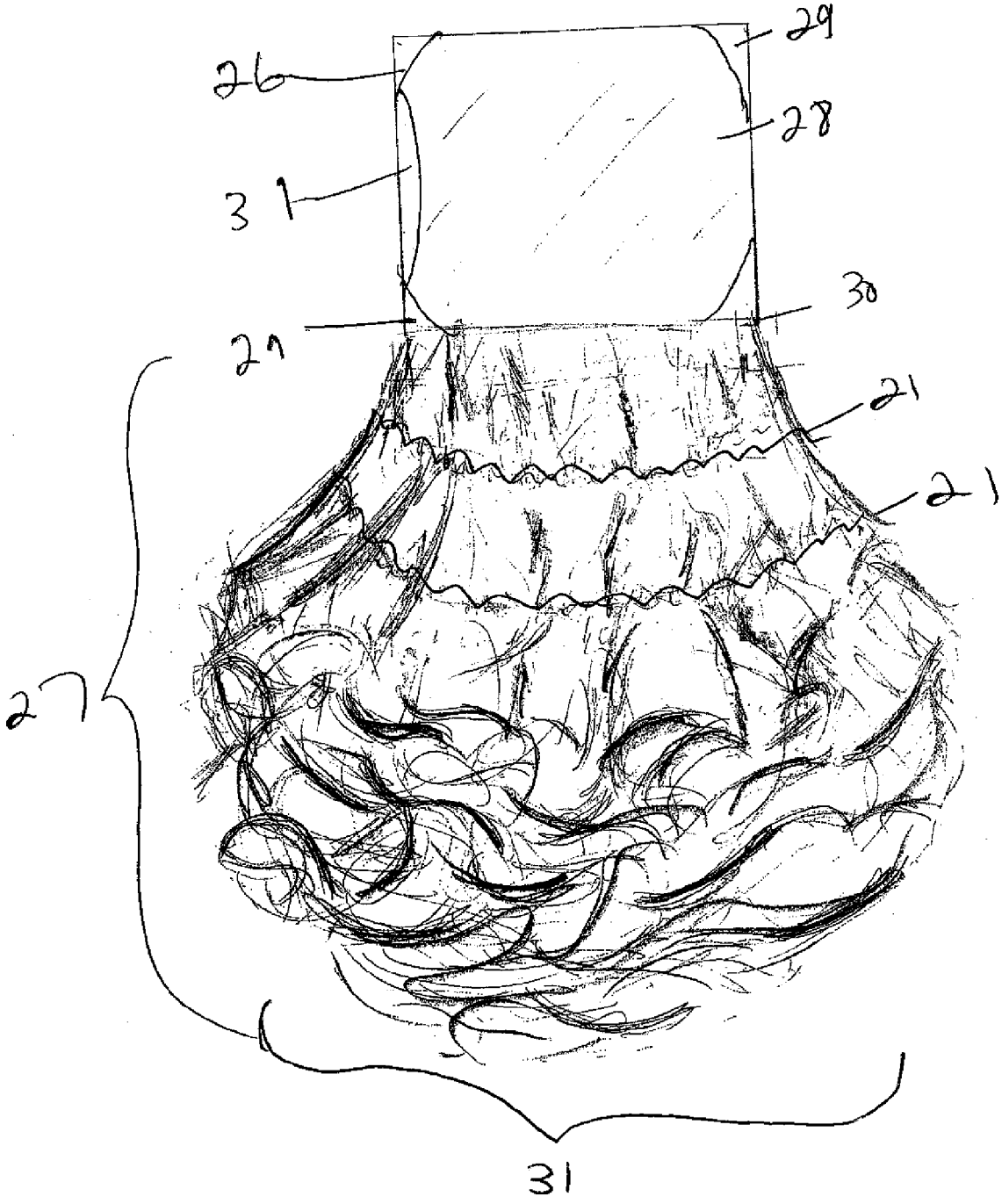
FIG. 6 shows a single ruffle insert unit.

FIG. 6 illustrates a single, ruffle insert. The ruffle insert comprises a planar panel 26 and a suspended ruffle skirt 27. The planar panel may comprise a firm, inexpensive component such as plastic 28, surrounded by a fabric enclosure 29 from which the suspended ruffle skirt 27 is attached through stitching 30, hook and loop fasteners, or other attachment means known in the art. In the preferred embodiment, the planar panel comprises of thin, yet rigid plastic having a rectangular shape surrounded by a fabric enclosure. Card board, metal or wood are other materials that may be used to comprise the firm component of the planar panel. In the preferred embodiment, the plastic material of the planar panel should have sufficient rigidity so that upon installation, as shown in FIG. 5, the user can simply push into position the planar panel between the box spring and mattress and insert the entire panel into position.

Alternatively, the planar panel may comprise solely of the fabric enclosure so that the user installs the ruffle insert simply by attaching the planar panel directly to a box spring, through means known in the art, such as upholstery tacks, hook and loop fasteners, and or pins.

In the preferred embodiment of the invention, the plastic comprising the planar panel 26 is at least 12 inches in length and at least 10 inches in width to provide for optimum stability when inserted between a box spring and mattress. The planar panel further comprises a fabric enclosure 29 which may be constructed from the same material as the suspended ruffle skirt 27 or a different material from which the suspended ruffle skirt is constructed from. The enclosure may have an opening 31 to allow for the quick removal and insertion of the planar panel. In the preferred embodiment, an opening is provided, having dimensions of at least as wide as the width of the planar panel so that the user may temporarily remove the plastic component of the planar panel from the fabric enclosure, so that the fabric enclosure and suspended ruffle skirt may be washed in a washing machine.

The construction of the suspended ruffle skirt comprises of multiple layers of rigid material such as tulle, netting, floral material, crinoline, organza, and/or taffeta. Combinations of the different material may be employed to construct the suspended ruffle skirt 27. The suspended ruffle skirt further comprises a monofilament which is integrated into the layers in order to gather and join the multiple layers of material comprising the suspended skirt so that a monofilament latitudinal band 21 is created. In the preferred embodiment of the invention, two monofilament latitudinal bands are created within the length of the suspended ruffle skirt.

The voluminous span of the suspended ruffle is achieved by employing multiple layers of rigid material such as tulle and joining the layers in a gathered configuration through the monofilament latitudinal bands. A tiered, voluminous visual effect is achieved due to the manner in which the individual layers making up the suspended ruffle are held together using the monofilament. The tiered configuration of the ruffle insert can be clearly seen in FIG. 6.

Referring directly to FIG. 6, the suspended ruffle skirt is made up of multiple layers of material, with each layer having a different width 31 from the layer directly adjacent to it. In the area where monofilament latitudinal bands 21 are formed, the widths of the individual layers are gathered and positioned next to one another in such a manner so that the width of all of the layers of material are made equal, and this configuration is held in place through the use of the monofilament latitudinal band 21, which is integrated into each of the layers and joins the multiple layers together, keeping the layers in place. The visual effect that is achieved by the gathering of the layers and binding in position by the monofilament is that of a tiered, voluminous skirt.

Figure 7:
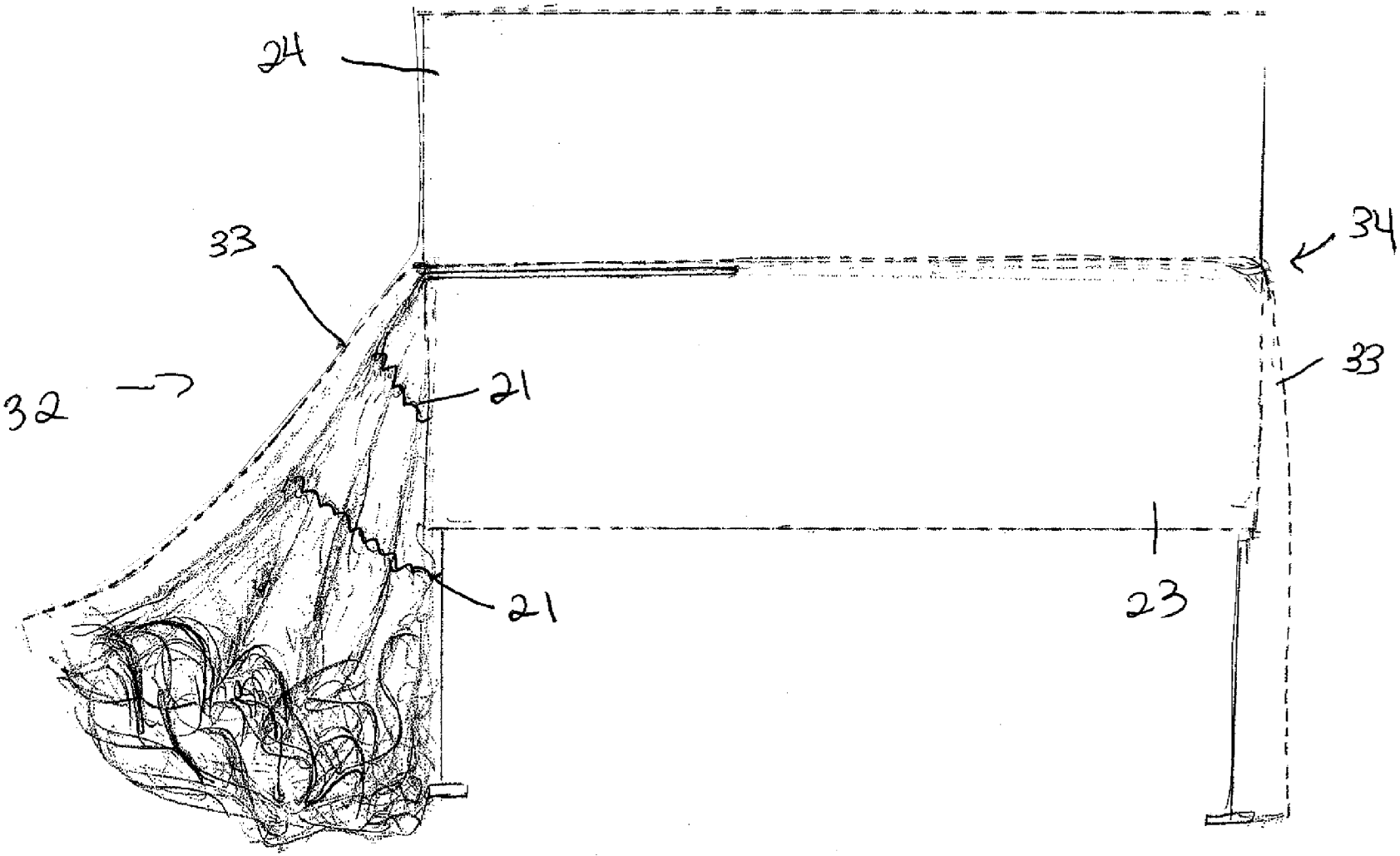
FIG. 7 shows a head, planar view of the ruffle insert with a conventional bed skirt positioned above the ruffle insert.

FIG. 7 illustrates the effect that is achieved by using the ruffle insert. On the left side of the drawing FIG. 32, a ruffle insert is installed between a mattress 24 and a box spring 23. Once a conventional bed skirt is installed above the box spring, a user installs the ruffle insert beneath the bed skirt 33 and above the box spring. The bed skirt appears full and is lifted away from the box spring. The monofilament latitudinal bands 21 keep the suspended ruffle skirt inwards in the area around the bands, and the remainder of the suspended ruffle skirt cascades outwards, forming a tiered and full appearance. On the right side of the assembly 34, no ruffle insert is employed so that the conventional bed skirt appears flat and shapeless. There is no volume to the bed skirt and the conventional bed skirt simply hangs directly against the box spring.

With respect to the above description, it is to be realized that the optimum dimensional relationships for the parts of the invention, to include variations in size, materials, shape, form, function, manner and use are deemed readily apparent and obvious to one skilled in the art, and all equivalent relationships to those illustrated in the drawings and described in the specification are intended to be encompassed by the present invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, and still fall within the scope of the invention.

The invention claimed is:

1. A bed skirt enhancing apparatus for placement beneath a bed skirt comprising:

multiple layers of rigid material;

monofilament latitudinal bands integrated within the multiple layers of rigid material;

said monofilament latitudinal bands holding said multiple layers of rigid material together in a gathered configuration;

said sheath spans a distance sufficient to surround a perimeter of a box spring of a mattress;

a band for securing said sheath to the box spring;

attachment means for joining opposite ends of said band.

2. The bed skirt enhancing apparatus for placement beneath a bed skirt claimed in claim 1 further comprising:

wire incorporated in the lower most edge of the multiple layers of rigid material.

3. The bed skirt enhancing apparatus for placement beneath a bed skirt claimed in claim 1 further comprising:

piping incorporated in the lower most edge of the multiple layers of rigid material.

* * * * *